United States Patent [19]

Ungarean et al.

[11] Patent Number: 4,522,247

[45] Date of Patent: Jun. 11, 1985

[54] INFRARED IMAGING FOR ELECTROMAGNETIC CASTING

[75] Inventors: Gary L. Ungarean, Woodbridge; John C. Yarwood, Madison, both of Conn.

[73] Assignee: Olin Corporation, New Haven, Conn.

[21] Appl. No.: 111,244

[22] Filed: Jan. 11, 1980

[51] Int. Cl.[3] ..... B22D 27/02

[52] U.S. Cl. ..... 164/150; 164/503

[58] Field of Search ..... 164/4, 150, 154, 155, 164/449, 49, 147, 250, 251, 82; 219/10.75, 10.77, 10.79; 250/357, 340, 342, 349, 577; 73/355 R

[56] References Cited

U.S. PATENT DOCUMENTS

| | | | |
|---|---|---|---|
| 3,204,460 | 9/1965 | Milnes | 73/295 |
| 3,237,251 | 3/1966 | Thalmann | 164/4 |
| 3,646,988 | 3/1972 | Getselev | 164/251 |
| 3,667,296 | 6/1972 | Schiefer et al. | 164/4 X |
| 3,706,399 | 12/1972 | Sundberg | 164/449 X |
| 3,838,727 | 10/1974 | Levi et al. | 164/4 |
| 3,842,894 | 10/1974 | Southworth et al. | 164/4 |
| 4,014,379 | 3/1977 | Getselev | 164/4 |
| 4,015,128 | 3/1977 | Della Vedova | 250/342 |
| 4,121,459 | 10/1978 | MaCall et al. | 250/349 X |
| 4,132,259 | 1/1979 | Poncet | 164/4 |
| 4,160,168 | 7/1979 | Funck | 250/564 |

FOREIGN PATENT DOCUMENTS

| | | | |
|---|---|---|---|
| 833454 | 2/1970 | Canada | 164/49 |
| 913323 | 10/1972 | Canada | 164/49 |
| 2854515 | 6/1979 | Fed. Rep. of Germany | 164/449 |
| 273226 | 4/1967 | U.S.S.R. | 164/49 |
| 338036 | 1/1969 | U.S.S.R. | 164/49 |
| 338297 | 7/1970 | U.S.S.R. | 164/49 |

OTHER PUBLICATIONS

"Develops New Molten Metal Measuring System for Continuous-Casters" Journal of Metals, Jul. 1979, pp. 14-15.

*Primary Examiner*—Kuang Y. Lin

*Attorney, Agent, or Firm*—Howard M. Cohn; Barry L. Kelmachter; Paul Weinstein

[57] ABSTRACT

A process and apparatus for determining the value of parameters which affect emissivity of radiation from a metal load in an electromagnetic casting system. Infrared radiation being emitted from the surface of the load is sensed by an array of fiber optic filaments secured within elements of the electromagnetic casting system. Radiation signals are transmitted by the filaments to a signal processor which enables readout display of electromagnetic casting parameters such as liquid temperature, maximum load temperature, position of the liquid/solid interface, and head position.

20 Claims, 7 Drawing Figures

INFRARED IMAGING FOR ELECTROMAGNETIC CASTING

BACKGROUND OF THE INVENTION

Electromagnetic (hereinafter EM) casting processes and apparatuses have been known and used for many years for continuously and semi-continuously casting metals and alloys. In many of these processes it is desirable to know at any instant of time during the EM casting run the location or value of various casting parameters, as for example the load height, the maximum temperature of the load, the location of the liquid/solid interface of the forming ingot, the liquidus temperature, etc.

The present invention relates to a safe, efficient, and reliable process and means for utilizing the emissivity of radiation from the load to measure the aforementioned parameters.

PRIOR ART STATEMENT

There are several prior art systems for measuring the location of the molten metal surface in a container or mold during a continuous casting run. One such system is shown in U.S. Pat. No. 3,204,460 and comprises a plurality of thermocouples spaced vertically along the container walls. The thermocouples measure temperature change within the container and activate an electric circuit in response to such measurement. The invention in U.S. Pat. No. 3,204,460 is based on the fact that a sharp change in the temperature measured within the container occurs as one travels from a pool of molten metal to a point above the pool and vice versa. The difficulty in adapting this approach to an EM casting system is that there is no molten metal contacting mold wall or container in EM casting in which one can place the thermocouples so as to place them in close proximity with the melt. Placement of any device between the EM inductor and the load would complicate the casting zone.

Another approach to determining molten metal surface level in a mold during a continuous casting run is disclosed in U.S. Pat. No. 3,667,296. Electrical resistance wire probes are placed into the molten metal being cast. As the molten metal rises or falls, the resistance change in a circuit associated with the probes is ascertained and used as a level indication. The difficulties with using such a system in an EM casting station are several. First, reliability problems exist as a result of having a primary measurement device in contact with the melt. Second, use of probes during electromagnetic casting causes perturbations in the liquid metal menisces which can result in casting defects. Finally, placement of a measuring device within the primary EM casting zone further complicates the zone.

Use of photo-electric devices, radiation responsive electrical devices, optoelectronic sensors, and electro-optical scanning systems in locating the surface of molten metals in a container during continuous casting is disclosed in U.S. Pat. Nos. 4,015,128, 3,842,894, 3,838,727, 4,132,259, and 4,160,168. All but one of the systems disclosed in these patents position the sensor devices such that the optical axis of the devices is at an angle with respect to the axis of the molten metal container. The devices thus require a reference point, that is they are utilized in such a fashion that their axes intersects the surface of the molten metal and the walls of the molten metal container. The axis of the photo-electric device in U.S. Pat. No. 4,132,259 intersects the wall of a molten metal feed nozzle. These systems operate within the visable light spectrum and presuppose a clear and uniform distinction between the container/feed nozzle and the molten metal surface color and are primarily useful in color determination rather than temperature determination of the melt.

In contrast, an EM casting system has no mold or container walls in contact with the melt to compare with. Moreover, EM systems typically utilize shields and coolant manifolds at the molten metal input ends of the primary casting zone. Utilization of such prior art electro-optical devices in the manner suggested by the aforementioned prior art would thus be complicated by the presence of these elements at the molten metal input end of the EM casting zone. Finally, in operating at the visable light spectrum, these devices are subject to inaccuracies based upon the existence of a dirty environment typically found in and around a casting station.

A method of head measurement which has been used during EM casting runs is depicted in U.S. Pat. No. 4,014,379, Canadian Pat. No. 913,323, and U.S.S.R. Pat. No. 338,036. Disclosed therein is the use of a float device which locates the upper surface of the molten metal being EM cast. Again, reliability problems associated with having the primary measuring device in contact with or subject to damage by the melt exist. A reliability problem also exists with respect to a feeler device disclosed in U.S. Pat. No. 3,646,988, the device being utilized to feel or locate the interface between the liquidus and solidus parts of an ingot being electromagnetically cast. In addition to reliability problems, these prior art patents require that additional equipment be added to the EM containment zone which complicates the EM casting apparatus and places the sensing elements in a very vulnerable position. Moreover, as noted hereinabove, use of such devices during electromagnetic casting may cause surface perturbations in the liquid metal meniscus which can result in casting defects.

Another system for locating the head in an EM casting or containment zone and a continuous casting mold is disclosed in U.S.S.R. Pat. Nos. 338,297, 273,226, and bulletin report section "...Develops New Molten Metal Measuring System for Continuous-Casters..." in the *Journal of Metals,* July 1979, pp. 14 and 15. All of these disclosures utilize at least one sensing coil placed in the vicinity of the molten metal surface in a continuous casting system. The impedance value of the coil, which varies as the molten metal moves up or down, is used as an indication of the location of the top surface of the melt. As with feeler and float devices discussed hereinabove, this approach necessitates that additional equipment must be added to the EM containment zone thereby complicating the EM casting apparatus and placing the sensing elements in a vulnerable position.

Canadian Pat. No. 833,454 discloses the use of a system of intensified ultrasonic wave reflection at the solidification front of a continuously cast ingot in order to locate the front. The system involves the use of electromagnetic agitating coils in the area of the solidification front and requires direct coupling to the molten metal. Such a system is not readily adaptable to an EM casting system which, of course, itself is driven by an electromagnetic inductor spaced from the surface of the load. Interposition of ultrasonic equipment would be necessity complicate an EM casting zone.

Finally, U.S. Pat. No. 3,237,251 discusses the use of measuring systems utilizing electrical conductivity variation, high frequency waves, and the like to measure the location of the depth of liquid center (core tip) in a continuously cast ingot so as to be able to control speed of withdrawal and prevent strand cutting and breakouts which put the casting machine out of operation. The measuring systems disclosed in U.S. Pat. No. 3,237,251 are all located at a point along the cast strand outside the mold or casting zone at the downstream end thereof and are not adapted for ready insertion and utilization in an EM casting zone wherein the melt is supended within an inductor.

A system utilizing measurement of the in-phase component of the inductor current during an electromagnetic casting process as an indication of the height of the liquid metal head and location of the liquid/solid interface is disclosed in copending U.S. Patent Application Ser. No. 137,654, filed Apr. 7, 1980, by Kindlmann et al., for "Determination of Liquid Metal Head in Electromagnetic Casting". At constant frequency, and knowing the air gap between inductor and load and load surface height, the system permits for determination of the actual depth of liquid (the liquid metal head), and location of the liquid/solid interface by utilizing the different resistivities of the solid and liquid states of the metal or alloy being cast. While this system allows for determination of the value of liquid metal head and interface position without interposition of probes or separate measuring devices within the primary EM casting station, it requires a knowledge of the load height, which frequently may vary during an electromagnetic casting run. Thus, a system which constantly measures load height or which maintains load height steady is required.

A process for measuring load surface position during electromagnetic casting of metals and alloys utilizing screen inductance is disclosed in copending U.S. Patent Application Ser. No. 137,596, filed Apr. 7, 1980 by, Kindlmann et al., for "Head Measurement Utilizing Screen Inductance in Electromagnetic Casting". By monitoring various parameters of the electromagnetic casting system, such as the current in the non-magnetic shield, the current in the inductor, and the voltage across the inductor, determination of the location of the proximity of the surface of the load to the shield is carried out. While this system has the benefit of being able to determine location of the load upper surface without introduction of props or other measuring devices into the casting zone, and without modification of the electromagnetic casting system elements, it is limited to the extent that the location of the liquid/solid interface and the value of other EM casting parameters which may be of interest are not determined.

The present invention overcomes the deficiencies described above and provides an accurate means for measuring and locating the head surface height, the maximum temperature of the load, the location of the peripheral liquid/solid interface of the forming ingot, and the liquidus temperature in an EM casting station without necessitating the introduction of any sensing element into the EM casting zone enclosed by the inductor and shield, simultaneously, reliably, and without creation of any safety hazards (such as would be introduced for example by devices utilizing radiation detectors). In addition, the measuring system of the present invention operates efficiently in less than perfectly clear environments such as those typically found in and around an EM primary casting zone.

All patents and publications described herein are intended to be incorporated by reference.

SUMMARY OF THE INVENTION

In accordance with this invention, sensing of head position, load maximum temperature, location of liquid/solid interface, and liquid temperature is carried out through the use of an infrared imaging system which is secured within an element or elements of the EM casting apparatus and thus is removed from the primary EM casting zone. The infrared imaging system accomplishes non-contacting measurements of the load parameters in a less than perfectly clear environment without complicating the EM primary casting zone, and presents no health problems. This is accomplished by establishing one or more generally vertical sensor arrays around the load by mounting fiber optic filaments in the EM shield or an extension thereof, and/or in the inductor, and/or in the water manifold. The infrared signals from the load are delivered by the filaments to a signal processor which processes and converts the signals into readable form. In operating in the infrared spectrum, the sensors of the measuring system of the present invention are very effectively indicative of the characteristic radiation/temperature of the EM load.

DETAILED DESCRIPTION OF PREFERRED EMBODIMENTS

Figure 1:
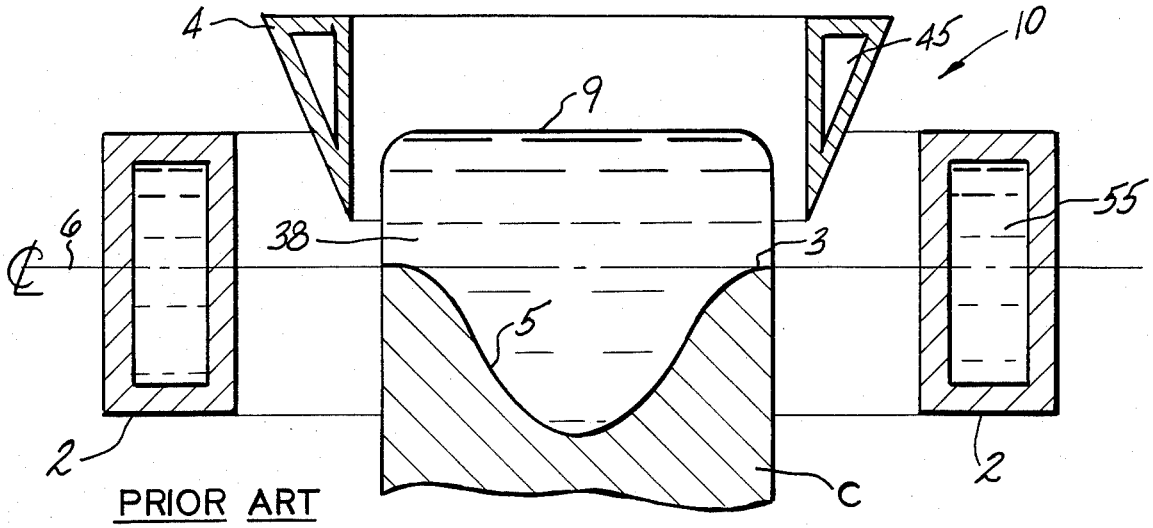
FIG. 1 is a schematic cross-sectional representation of a prior art electromagnetic casting apparatus for forming molten metal or alloy into an ingot.

Referring now to FIG. 1, there is shown therein by way of example known EM casting apparatus elements. The EM casting mold 10 is comprised of an inductor 2 (normally water cooled) and a non-magnetic screen or shield 4. The primary casting zone of the EM casting system is defined by the inductor 2 and shield 4. Molten metal is continuously introduced into the mold 10 during a casting run. The inductor 2 is excited by an alternating current from a suitable power source (not shown).

The alternating current in the inductor 2 produces a magnetic field which interacts with the molten metal head 8 to produce eddy currents therein. These eddy currents in turn interact with the magnetic field and produce forces which apply a magnetic pressure to the molten metal head 8 to contain it so that it solidifies in a desired ingot cross section.

An air gap exists during EM casting between the molten metal head 8 and the inductor 2. The molten metal head 8 is formed or molded into the same general shape as the inductor 2 thereby providing the desired ingot cross section. The inductor 2 may have any desired shape including circular or rectangular as required to obtain the desired ingot C cross section.

The purpose of the non-magnetic shield 4 is to fine tune and balance the magnetic pressure with the hydrostatic pressure of the molten metal head 8. For this reason, as well as others relating to various measurement and control systems, it is frequently necessary or desirable to know the position of the metal head 8.

The solidification front 5 of the casting comprises the boundary between the molten metal head 8 and the solidified ingot C. It is most desirable to maintain the solidification front 5 at the surface 3 of the load/ingot C at or close to the plane of maximum magnetic flux density which usually comprises the plane passing through the electrical centerline 6 of the inductor 2. In this way, the maximum magnetic pressure opposes the maximum hydrostatic pressure of the molten metal head 8. This results in the most efficient use of power and reduces the possibility of cold folds or bleedouts. Thus, the location of the solidification front 5 at the surface 3 of the ingot C becomes another EM casting parameter of interest.

Reference is made to the aforementioned U.S. Pat. No. 3,646,988 and U.S.S.R. Pat. No. 338,297 for EM casting arrangements similar to that depicted in FIG. 1.

Figure 2:
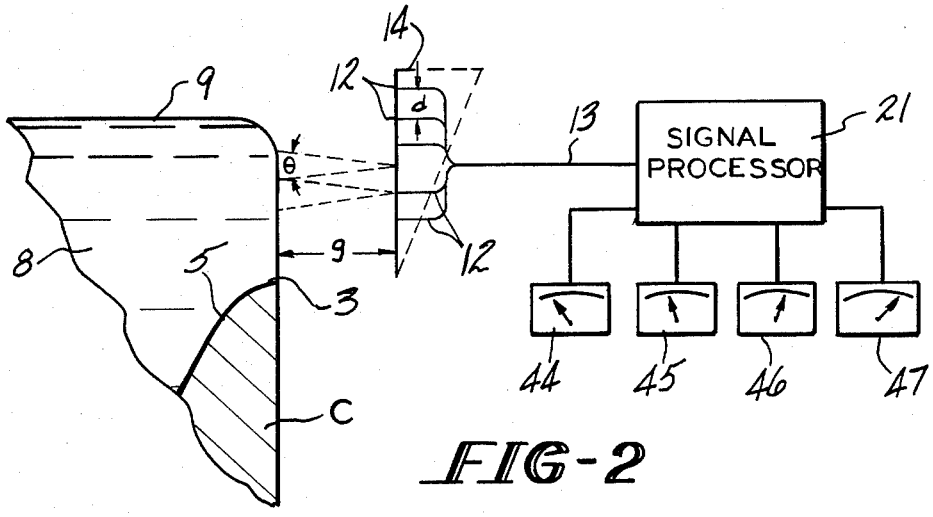
FIG. 2 is a partial schematic representation of an infrared imaging system in accordance with the present invention showing a plurality of filaments secured within an EM shield and positioned adjacent the upper portion of an EM load.

An infrared sensitive sensor array in accordance with a first embodiment of this invention is shown in FIG. 2 wherein the array is fabricated by mounting a plurality of optic filaments 12 in the EM shield 14, The filaments 12 are shown arranged in a vertical array with a spacing d therebetween and may consist of plastic or glass cables of the step graded junction or continuous graded junction variety. The array need not be perfectly vertical, and a generally vertical array would be suitable with the vertical distance between filaments being the same as spacing distance d. A protective lens 16 (FIG. 4) should be positioned at the end of each filament to seal the fiber, focus the radiation, and control the numerical aperture of the sensing probe.

Each lens-fiber combination has a numerical aperture of $\sin \frac{1}{2}\theta$, where $\theta$ is the total angle of acceptance. With a sensor to target distance g, the optimum sensor spacing is then $$d_{opt} = 2\ g\ \mathrm{Tan}\ \tfrac{1}{2}\theta \qquad (1)$$

That is, the cones of acceptance are tangent when projected to the target. The resolution of the system is basically set by the spacing d of the sensors in the array. For increased resolution more sensors must be used with a smaller spacing and numerical aperture. The infrared radiation collected by the sensor array is then channeled to the signal processor 21 via the fiber optic cable 13.

For typical EM casting station geometry, the value of d should be from about 1 to about 10 mm, and preferably from about 1 to 6 mm.

It is possible to utilize only one optic filament to determine the location of the melt surface 9 where time is an element of the measuring system. In such a system it is necessary to know where the surface 9 should be in order to determine the location of the single optic filament. Then as the head oscillates up or down the optic filament will see radiation or no radiation (relatively), i.e. the beam is continuously broken where time is an element. When the element sees radiation repeatedly, the surface 9 is too high, and adjustment can be made to the system. When there is no radiation (relatively), the surface 9 is too low, and the system can be adjusted to raise the surface. It is also within the scope of the present invention to provide a generally vertical array of fiber optic filaments located at approximately the same elevation as a plane passing through the electrical center line of the inductor.

It is preferred in accordance with the present invention to utilize space only, without time as an element of the system. Thus, two or more optic filaments are required in each filament array. In the case of locating the liquid/solid interface, it is necessary to generate a mathematical curve of temperature gradients, and it is, therefore, preferred to utilize four or more optic filaments above and below the projected interface of centerline of the EM inductor to generate the function for the curves.

The spectral response required of the optics is estimated using "Wein's Displacement Law"

$$T\ \lambda_{max} = 2900\ \mu\ {}^{\circ}\mathrm{K} \qquad (2)$$

where

T=temperature of body $\lambda_{max}$=maximum wavelength $\mu$=microns

°K=degrees Kelvin

Over the temperature range of interest during EM casting the radiation wavelength is $$1.8\ \mu \lesssim \lambda_{max} \lesssim 4.8\ \mu <=> 1600^{\circ}\ \mathrm{K.} \gtrsim T \gtrsim 600^{\circ}\ \mathrm{K.}$$

where $1\mu = 10^{-4}$ cm.

Figure 3:
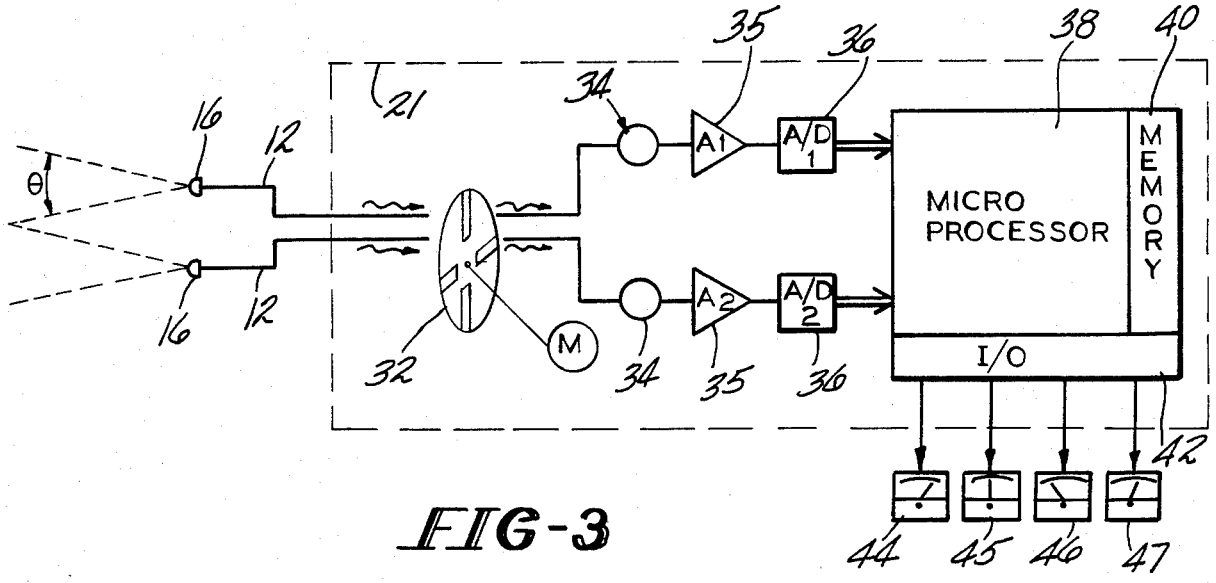
FIG. 3 is a block diagram of the infrared imaging system of the present invention showing the treatment of infrared signals eminating from the surface of the EM load from filament lens to final parameter readout.

The signal processor 21 which will use the received radiation information to compute the temperature and temperature gradient along the surface of the load can be divided into two sections, analog and digital (see FIG. 3). The purpose of the analog section is to convert the received radiation signal to a digital word. This is accomplished by first optically chopping the radiation, such as by motor (M) driven optical chopper 32, and then transforming it to an electrical signal via radiation detectors or sensors 34 which are characteristic of different wavelengths, amplifying and converting it to a digital word via AC coupled amplifiers 35 and analog to digital converters 36. All signal scaling, linearizing, pattern recognition, controlling and computation will be done within the digital portion of the signal processor 21 shown in FIG. 3 as microprocessor 38 and memory system 40. This digital portion of the signal processor 21 can be implemented with a standard microprocessor system or a dedicated logic network. The information output from the digital portion of the signal processor 21 emanates from information output 42 to individual meter readouts 44, 45, 46, and 47. Meter readouts 44 through 47 typically might display information regarding liquid temperature, liquid/solid interface position, head position and maximum temperature for operator use or automatic control.

Optic filaments 12 may be dealing with relatively small levels of radiation requiring a high gain amplifier. A stable high gain AC amplifier is preferred. Optical chopper 32 is provided to chop the dc radiation signals emanating from optic filaments 12 into pulses of light which can then be readily amplified by AC coupled amplifiers 35.

Use of optic filaments 12 enables transfer of load surface radiation to sensors 34 located in signal processor 21 enabling avoidance of the necessity of having to place such sensors in the primary casting station whose boundaries are defined by the EM inductor and nonmagnetic shields where they would be subject to damage and would interfere and complicate the primary EM casting station.

In general, the temperature and gradient of the load will gradually increase from something slightly less than the liquidus value at the solidification zone to something near the melt temperature at the top of the ingot. This can be sensed by the measuring apparatus and knowing the basic sensor spacing, d, the temperature and gradient can be displayed as a function of distance relative to some datum such as the bottom of the shield 14 or the top of the containment inductor 2. Above the top of the ingot the temperature and gradient will drop off quite rapidly. Thus, the melt surface 9 will be located at the point of maximum temperature, reversing and maximum gradient. In a similar fashion the solidification zone can be located. That is, at the solidification zone the temperature gradient should change from a small positive slope to one much larger. Then by coincidence of this gradient change with the melt surface temperature, both actual and theoretically expected, the solidification zone position can be estimated. Once calibrated for a particular process or melt, this information can then be displayed on devices such as individual meter readouts 44, 45, 46, and 47.

Figure 4:
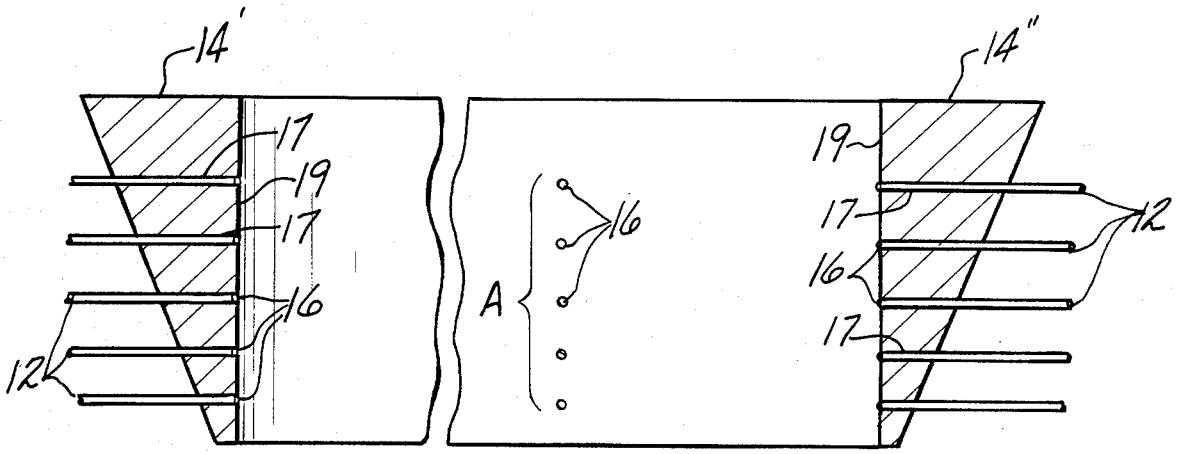
FIG. 4 is a partial schematic cross section through two EM shield elements showing two embodiment of the present invention.

Referring to FIG. 4, there is shown therein two embodiments in accordance with the present invention for providing an array of optic filaments 12 within EM shields. The EM shield 14′ shows optic filaments 12 placed within shield passages 17 with the tips or ends thereof recessed from the inner surface 19 of the shield. A protective lens 16 comprising a material such as quartz is then inserted within the recesses and are secured therein so as to be flush with the inner surface 19. Lenses 16 serve two functions, that is, by appropriately selecting the lens based upon the spacing d of filaments 12 and the distance g from the load, the field of view is appropriately focused as discussed hereinabove, and secondly, they keep out water, humidity, particles, and the like permitting effective sealing of the optic filaments 12.

The field of view is normally a characteristic of the particular optic filament used and less resolution results since filaments are typically made with a large field of view. Resolution of the system would, therefore, go down. This would only be acceptable if there were but a few filaments at a great spacing, such as for example greater than about 1 inch. With the limited overall sizes of EM casting elements typical in EM casting systems, space available for a plurality of filaments is limited, and it becomes desirable to limit the field of view accordingly.

Lenses 16 can be secured in passages 17 by various means such as by wedging them therein, glass welding or fusing, use of an adhesive agent with a refractive index mating with that of the lens 16 and the filaments 12, etc. The lens 16 is preferably made flush with inner surface 19 to allow ready inspection and easy cleaning of the lens.

Also depicted in FIG. 4 is a portion of a shield 14″ which is provided with an array of filaments 12, the ends of which are flush with inner surface 19 of the shield. In this particular embodiment the lenses 16 are secured to the ends of the filaments and project into the zone formed by the shield inner surface 19. Shield 14″ is also shown with a backup or auxiliary array of filaments and lenses A. By utilizing two or more arrays of filaments, a fault tolerant system can be included in the signal processor 21 and an override from one array or from one filament in an array to another array or filament therein can be provided to protect against breakdown of a filament as a result of mechanical, dirt, and other complications. Thus as a safety provision, the measurement system and signal processor 21 of the present invention may be provided with means to switch off from one filament at a particular level in one array to a filament at the same level in another array, or to switch off from one array to another.

Placing of optic filaments 12 in the EM shield typically enables determination of a parameter such as head height, but would not readily enable placement of filaments 12 such that the location of the liquid/solid interface could be readily measured.

Figure 5:
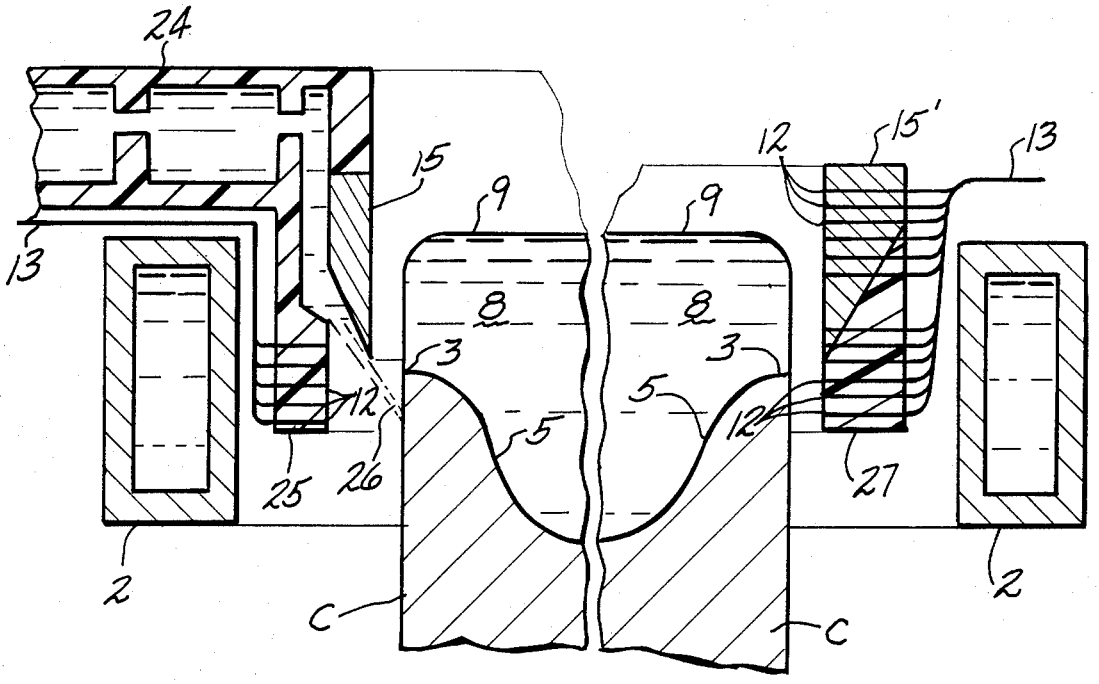
FIG. 5 is a partial schematic cross section of two EM casting stations showing filaments secured in a shield and in an extension thereof and alternatively in a portion of a coolant manifold in accordance with two more embodiments of a the present invention.

Two embodiments for enabling placement of optic filaments 12 in the vicinity of the liquid/solid interface are disclosed in FIG. 5. A coolant manifold 24, having a shield portion 15, for supplying a stream of water 26 to cool ingot C is also provided with a carrier portion 25 extending into the zone between inductor 2 and the liquid/solid interface of ingot C. Optic filaments 12 are secured in carrier portion 25 of coolant manifold 24 as shown in FIG. 5 and thus are in a desirable position to measure ingot radiation and, therefore, to locate the position of the liquid/solid interface.

An alternative embodiment to carrier portion 25 of coolant manifold 24 would be to utilize a carrier portion such as portion 27 or shield 15′. As was the case with carrier portion 25′, carrier portion 27 of shield 15′ extends into the zone between inductor 2 and the liquid/solid interface of ingot C enabling placement of optic filaments 12 as shown in FIG. 5 such that it is readily possible to measure ingot radiation in the area of the liquid/solid interface.

It should, of course, be understood that carrier portions 25 and 27 must be constructed of a material, such as plastic for example, which does not absorb current from inductor 2 while allowing at the same time positioning of the optic filaments 12.

Figure 6:
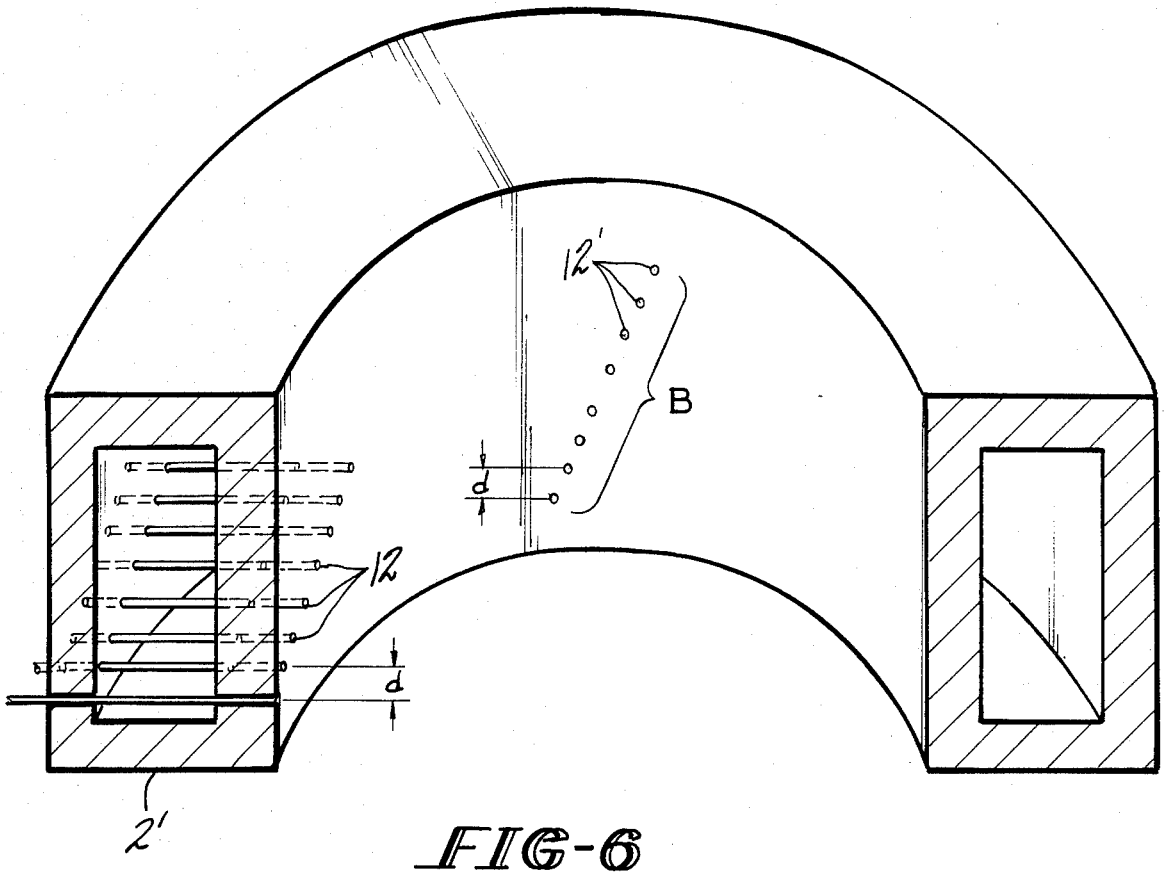
FIG. 6 is a partial cross section in perspective of an inductor having a plurality of filaments embedded therein in accordance with yet another embodiment of the present invention.

FIG. 6 depicts yet another embodiment of the present invention which enables placement of optic filaments opposite to and in the vicinity of the liquid/solid interface of ingot C. An EM inductor 2′ is provided with an array of optic filaments 12 which may be utilized to measure the location of the liquid/solid interface as discussed hereinabove. While the vertical spacing d between filaments 12 is established in the same way as in the case of filament insertion in EM shields, the filaments should not, however, be placed in a longitudinal line along the inductor since such placement would create a high resistance. Thus, in a preferred form, the filaments 12 are dispersed in a spiral arrangement over a quadrant or a portion thereof so as to go up the inductor in a helical fashion, that is displaced angularly by some amount. Again multiple filament arrays may be utilized to provide an auxiliary or backup sensor system.

Figure 7:
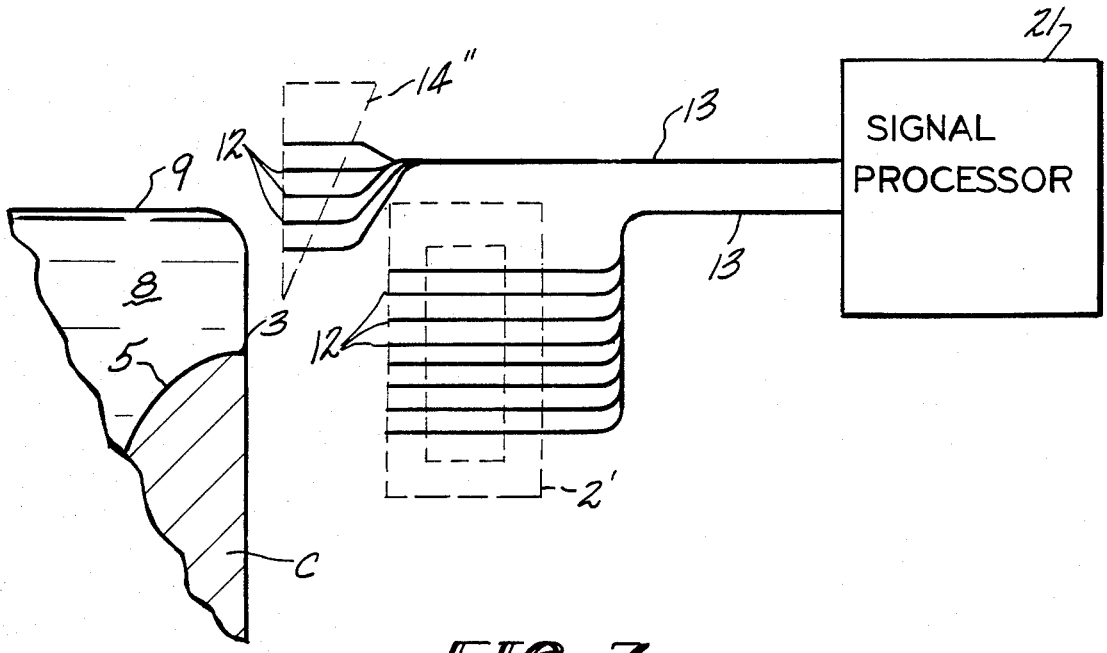
FIG. 7 is a partial schematic representation of another embodiment of the infrared imaging system of this invention showing filaments secured within both the shield and the inductor of an EM casting system.

FIG. 7 is a partial schematic representation of a measuring system in accordance with the present invention wherein optic filaments 12 are located in both an EM shield 14'' (shown in phantom) and an inductor 2' (also shown in phantom). Such an embodiment can be readily utilized to measure the four parameters depicted by meter readouts 44, 45, 46, and 47 in FIGS. 2 and 3.

Because of the small diameter of standard optic filaments, typically less than about 40 thousandths of an inch, both the EM shield and the EM inductor may be internally cooled, see coolant channels 45 and 55, respectively, in FIG. 1, without severe limitations due to the presence of portions of optic filaments 12 therein in accordance with this invention. It is, of course, also possible to externally cool these elements without regard to the existence of optic filaments therein.

It should be readily apparent that the infrared imaging system of the present invention may be utilized to determine the value of any parameters which affect the emissivity of radiation of an EM load.

It is apparent that there has been provided with this invention a novel infrared imaging system for accomplishing measurement of various temperature, head height, and liquid/solid interface parameters in EM casting which fully satisfy the objects, means, and advantages set forth herein before. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An infrared imaging system for determining the position of the liquid-to-solid interface at the periphery of a material load in an electromagnetic casting apparatus during a casting run, said electromagnetic casting apparatus including a primary casting zone defined at least in part by the inner surfaces of an inductor and defining a solidification zone including said liquid-to-solid interface, comprising:

means for sensing and collecting infrared radiation within said primary casting zone emanating from a vertical peripheral surface at the solidification zone of said load; and means responsive to said sensing and collecting means for providing a signal representative of the position of said liquid-to-solid interface.

2. An infrared imaging system as in claim 1 including readout means for receiving said indicative signal and for visually indicating the position of the liquid-to-solid interface.

3. An infrared imaging system as in claim 2 wherein said readout means indicates the position of the liquid-to-solid interface relative to a preselected datum point.

4. An infrared imaging system as in claim 3 wherein said sensing and collecting means further senses and collects infrared radiation emanating from the primary casting zone, responsive means further provides signals representative of the head position of said load, the liquid temperature of said load, and the maximum temperature of said load, said readout means further including means to indicate said head position relative to a second datum point, and including means to indicate said liquid temperature and said maximum temperature of said load.

5. An infrared imaging system as in claim 1 wherein said sensing and collecting means comprises at least one generally vertical array of at least two fiber optic filaments, said fiber optic filaments having a vertical spacing d between adjacent filaments.

6. An infrared imaging system as in claim 5 wherein the value of d is determined by the equation $$d = 2g \operatorname{Tan} \tfrac{1}{2}\theta$$

where g = sensor to load periphery distance, and $\frac{1}{2}$ = total angle of acceptance.

7. An infrared imaging system as in claim 1 wherein said sensing and collecting means comprises at least two generally vertical arrays of fiber optic filaments, each of said arrays having at least two fiber optic filaments, said at least two generally vertical arrays being at the same elevation relative to said casting zone, and further including means for processing said representative signal, said processing means including a fault tolerant system whereby if said signal from one or more of said at least two fiber optic filaments in one of said vertical arrays should fail, processing of signals from another of said at least two vertical arrays is automatically carried out.

8. An infrared imaging system as in claim 5 wherein said at least one generally vertical array comprises at least eight fiber optic filaments, at least four of said fiber optic filaments being located above a plane passing through the electrical centerline of said inductor, and at least four of said fiber optic filaments being located below said plane.

9. An infrared imaging system as in claim 5 wherein said vertical spacing is in the range of about 1 to about 6 mm.

10. An infrared imaging system as in claim 6 wherein said sensing and collecting means includes individual lens means at the ends of each of said at least two fiber optic filaments for focusing said infrared radiation.

11. An infrared imaging system as in claim 5 wherein said at least one generally vertical array is located above a plane passing through the electrical center line of said inductor.

12. An infrared imaging system as in claim 5 wherein said at least one generally vertical array is located at approximately the same elevation as a plane passing through the electrical centerline of said inductor.

13. An infrared imaging system as in claim 11 wherein said at least one generally vertical array is secured within passages in said non-magnetic shield, the ends of said at least two fiber optic filaments being approximately positioned at said inner surface of said non-magnetic shield.

14. An infrared imaging system as in claim 12 wherein said non-magnetic shield includes a vertically extending carrier portion, said at least one generally vertical array being secured within passages in said carrier portion, the ends of said at least two fiber optic filaments being approximately positioned at the inner surface of said carrier portion.

15. An infrared imaging system as in claim 12 wherein said electromagnetic casting apparatus includes a coolant manifold, said at least one generally vertical array being secured within passages in said manifold, the ends of said at least two fiber optic filaments being approximately positioned at the inner surface of said manifold.

16. An infrared imaging system as in claim 5 wherein said sensing and collecting means comprises at least two generally vertical arrays, a first one of said at least two generally vertical arrays being located at approximately the same elevation as the desired head position of said load, and a second one of said at least two generally vertical arrays being located at approximately the same elevation as a plane passing through the electrical centerline of said inductor.

17. An infrared imaging system as in claim 16 wherein said non-magnetic shield includes a vertically extending carrier position, said first one of said at least two generally vertical arrays being secured within passages in said non-magnetic shield, and said second one of said at least two generally vertical arrays being secured within passages in said vertically extending carrier portion.

18. An infrared imaging system as in claim 16 wherein said electromagnetic casting apparatus includes a coolant manifold, said first one of said at least two generally vertical arrays being secured within passages in said nonmagnetic shield, and said second one of said at least two generally vertical arrays being secured within passages in said coolant manifold.

19. An infrared imaging system for determining the value of at least one parameter which affects emissivity of radiation emanating from the metal or alloy load in an electromagnetic casting apparatus during a casting run, said electromagnetic casting apparatus including a primary casting zone defined at least in part by the inner surfaces of an inductor and a nonmagnetic shield, comprising:

means for sensing and collecting infrared radiation within said primary casting zone emanating from the surface of said load, said sensing and collecting means comprises at least one generally vertical array of at least two fiber optic filaments, said fiber optic filaments having a vertical spacing d between adjacent filaments;

said at least one generally vertical array is located at approximately the same elevation as a plane passing through the electrical centerline of said inductor;

said at least one generally vertical array further being secured within passages in said inductor, the ends of said at least two fiber optic filaments being approximately positioned at said inner surface of said inductor, said at least two fiber optic filaments further being helically arranged in said inductor; and means for transmitting at least one infrared radiation signal representative of the magnitude of said collected infrared radiation and the value of said at least one parameter to an area outside said primary casting zone.

20. An infrared imaging system for determining the value of at least one parameter which affects emissivity of radiation emanating from the metal or alloy load in an electromagnetic casting apparatus during the casting run, said electromagnetic casting apparatus including a primary casting zone defined at least in part by the inner surfaces of an inductor and a nonmagnetic shield, comprising:

means for sensing and collecting infrared radiation within said primary casting zone emanating from the surface of said load, said sensing and collecting means comprises at least one generally vertical array of at least two fiber optic filaments, said fiber optic filaments having a vertical spacing d between adjacent filaments;

said sensing and collecting means further comprising at least a second generally vertical array of at least two fiber optic filaments, a first one of the at least two generally vertical arrays being located at approximately the same elevation as the desired head position of said load, and a second one of said at least two generally vertical arrays being located at approximately the same elevation as a plane passing through the electrical centerline of said inductor, said first one of said at least two generally vertical arrays being secured within passages in said non-magnetic shield and said second one of said at least two generally vertical arrays being secured within passages in said inductor in a helical arrangement; and means for transmitting at least one infrared radiation signal representative of the magnitude of said collected infrared radiation and the value of said at least one parameter to an area outside said primary casting zone.

* * * * *